US009786429B2

(12) United States Patent
Liu et al.

(10) Patent No.: US 9,786,429 B2
(45) Date of Patent: Oct. 10, 2017

(54) BOBBIN AND MAGNETIC MODULE COMPRISING THE SAME

(75) Inventors: Chia-Ming Liu, Taoyuan Hsien (TW); Zhi-Liang Zhang, Taoyuan Hsien (TW); Yi Lin Chen, Taoyuan Hsien (TW); Po Yu Wei, Taoyuan Hsien (TW); Chih-Ming Chen, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 170 days.

(21) Appl. No.: 13/451,829

(22) Filed: Apr. 20, 2012

(65) Prior Publication Data

US 2012/0286916 A1 Nov. 15, 2012

(30) Foreign Application Priority Data

May 10, 2011 (TW) ..... 100116235 A

(51) Int. Cl.

| | |
|---|---|
| ***H01F 27/30*** | (2006.01) |
| ***H01F 27/29*** | (2006.01) |
| ***H01F 27/28*** | (2006.01) |
| ***H01F 27/32*** | (2006.01) |

(52) U.S. Cl.

CPC ..... *H01F 27/306* (2013.01); *H01F 27/325* (2013.01)

(58) Field of Classification Search

CPC .... H01F 27/325; H01F 27/306; H01F 27/292; H01F 5/02; H01F 2005/043; H01F 27/326

USPC ..... 336/192, 195, 196, 220, 222, 198

See application file for complete search history.

(56) References Cited

U.S. PATENT DOCUMENTS

| | | | | | |
|---|---|---|---|---|---|
| 3,436,574 | A | * | 4/1969 | Larsson | 310/194 |
| 3,605,055 | A | * | 9/1971 | Grady | 336/185 |
| 3,606,195 | A | * | 9/1971 | Freeman, Jr. et al. | 242/118.7 |
| 3,644,156 | A | * | 2/1972 | Petrinjak et al. | 156/90 |
| 3,652,968 | A | * | 3/1972 | Johnston et al. | 336/170 |
| 4,234,865 | A | * | 11/1980 | Shigehara | 336/92 |
| 5,464,171 | A | * | 11/1995 | Ripplinger | 242/609.1 |
| 5,524,334 | A | * | 6/1996 | Boesel | 29/605 |

(Continued)

FOREIGN PATENT DOCUMENTS

| | | | |
|---|---|---|---|
| CN | 1406386 | A | 3/2003 |
| CN | 1427427 | A | 7/2003 |

(Continued)

OTHER PUBLICATIONS

First Office Action of Taiwanese Patent Application No. 100116235, dated Sep. 23, 2013, with English summary.

(Continued)

*Primary Examiner* — Tsz Chan
*Assistant Examiner* — Kazi Hossain
(74) *Attorney, Agent, or Firm* — Cantor Colburn LLP

(57) ABSTRACT

A bobbin for use in a magnetic module is provided. The bobbin comprises a winding body, a first plate and a second plate. The winding body is disposed between the first plate and the second plate, and further comprises a first end, a second end and a through hole. The first end comprises a first buckling portion, and the through hole penetrates the first end and the second end. The first plate includes a second buckling portion and a first opening, while the second buckling portion is adapted to engage with the first buckling portion. The second plate includes a second opening, and the second plate is engaged with the second end of the winding body.

10 Claims, 8 Drawing Sheets

(56) References Cited

U.S. PATENT DOCUMENTS

| | | | | |
|---|---|---|---|---|
| 5,600,294 | A * | 2/1997 | Buenconsejo | H01F 5/02 242/614 |
| 6,008,708 | A * | 12/1999 | Endoh | H01H 49/00 29/622 |
| 6,073,869 | A * | 6/2000 | Schulz | 242/118.7 |
| 6,371,404 | B1 * | 4/2002 | Christopherson et al. | 242/608.6 |
| 6,575,398 | B2 * | 6/2003 | Nakamura et al. | 242/608.7 |
| 6,598,824 | B2 | 7/2003 | Schmidt | |
| 6,759,936 | B2 | 7/2004 | Yeh et al. | |
| 6,879,235 | B2 | 4/2005 | Ichikawa | |
| 7,446,642 | B2 * | 11/2008 | Fang | H01F 17/04 336/198 |
| 7,859,380 | B2 * | 12/2010 | Hasenour et al. | 336/198 |
| 2004/0113739 | A1 | 6/2004 | Du et al. | |
| 2004/0183642 | A1 * | 9/2004 | Suzui | H01F 27/292 336/192 |
| 2007/0057757 | A1 * | 3/2007 | Chen | H01F 27/2866 336/212 |

FOREIGN PATENT DOCUMENTS

| | | | | |
|---|---|---|---|---|
| CN | 1558428 | A | | 12/2004 |
| CN | 101604570 | A | | 12/2009 |
| CN | 201358103 | Y | | 12/2009 |
| CN | 201435297 | Y | | 3/2010 |
| GB | 2261868 | | * | 6/1993 |
| JP | 2000-198627 | | * | 7/2000 |
| JP | 2000198627 | | * | 7/2000 |
| JP | 2000198627 | A | | 7/2000 |
| JP | 2002-324705 | A | | 11/2002 |
| TW | M339763 | | | 9/2003 |
| TW | 200522095 | | | 7/2005 |
| TW | M370815 | | | 12/2009 |
| TW | 201005769 | | | 2/2010 |

OTHER PUBLICATIONS

First Office Action of Taiwanese Patent Application No. 100116235, dated Dec. 9, 2013, with English summary.

Chinese Office Action corresponding to CN Application No. 201110128925.0; dated: Mar. 17, 2015, see English comments.

Chinese Office Action corresponding to CN Application No. 201110128925.0; dated: Sep. 28, 2014, see English comments.

Summary of the First and Second Office Actions for the CN Application No. 201110128925.0.

* cited by examiner

BOBBIN AND MAGNETIC MODULE COMPRISING THE SAME

This application claims priority to Taiwan Patent Application No. 100116235 filed on May 10, 2011.

CROSS-REFERENCES TO RELATED APPLICATIONS

Not applicable.

BACKGROUND

Technical Field

The present disclosure relates to a bobbin and a magnetic module comprising the same, and more particularly, a bobbin that can be manufactured separately from a winding and then be assembled with the winding as well as a magnetic module comprising the bobbin.

Descriptions of the Related Art

Generally, conventional magnetic modules comprise a bobbin, a coil and a magnetic core disposed inside the bobbin. The conventional magnetic module is usually produced in the following way: a wire is wound around the bobbin to form a winding, and then the winding is fixed to the bobbin to form a coil that is wound around the bobbin and, of course, around the magnetic core disposed inside the bobbin, thus a desired magnetic module is formed.

The bobbin used in the conventional magnetic module is advantageous in that it is simple in structure and has a low manufacturing cost. However, for the magnetic modules to receive a large input current, the winding must be made of wires with larger diameters. When the wires are wound around the bobbin, a large winding stress exerted on the bobbin due to the larger diameter of the wires, which is likely to cause damage to or deformation of the bobbin. This not only affects the degradation of the product yield of the magnetic modules, but also causes unneeded-waste in production and consequently increases the cost due to the deformation or fracture of the bobbins. On the other hand, after the coil is wound onto the bobbin, the coil is fixed onto the bobbin usually by an adhesive in the prior art. Therefore, if the coil is not securely fixed to the bobbin at an initial stage of the winding process, then problems such as misalignment of the coil or leakage of the residual adhesive will appear at the adhesive stage, which may also degrade the product yield of the magnetic modules.

In view of this, an urgent need exists in the art to provide a solution that can reduce or eliminate the winding stress exerted on the bobbin when the wire of a larger diameter is wound around the bobbin and that can avoid problems such as the misalignment of the coil or leakage of the residual adhesive during the adhesive stage.

BRIEF SUMMARY

An objective of the present disclosure is to provide a bobbin and a magnetic module comprising the same. The bobbin can be manufactured separately from a winding structure to be disposed thereon, and then be assembled with the winding structure to form the magnetic module.

Another objective of the present disclosure is to provide a bobbin that could be fixed by buckling. Thus, a wire may be wound onto a winding structure first, and then constructed with the bobbin. This can reduce the usage and amount of the adhesive for constructing the winding structure in the conventional winding process, and avoid damage or deformation of the bobbin due to the stress exerted on the bobbin during the winding process.

To achieve the aforesaid objectives, the bobbin of the present disclosure comprises a winding body, a first plate and a second plate. The winding body comprises a first end, a second end which is opposite the first end, and a through hole passing through the first end and the second end. The first end comprises at least one first buckling portion. The first plate comprises at least one second buckling portion and a first opening. The at least one first buckling portion of the winding body is adapted to engage with the at least one second buckling portion so that the first plate is detachably mounted on the first end of the winding body. The first opening is disposed corresponding to the through hole of the winding body. Similarly, the second plate comprises a second opening disposed corresponding to the through hole of the winding body, and the second plate engages with the second end of the winding body.

The detailed technology and preferred embodiments implemented for the subject disclosure are described in the following paragraphs accompanying the appended drawings for people skilled in this field to well appreciate the features of the claimed disclosure.

DESCRIPTION OF THE PREFERRED EMBODIMENT

Figure 1:
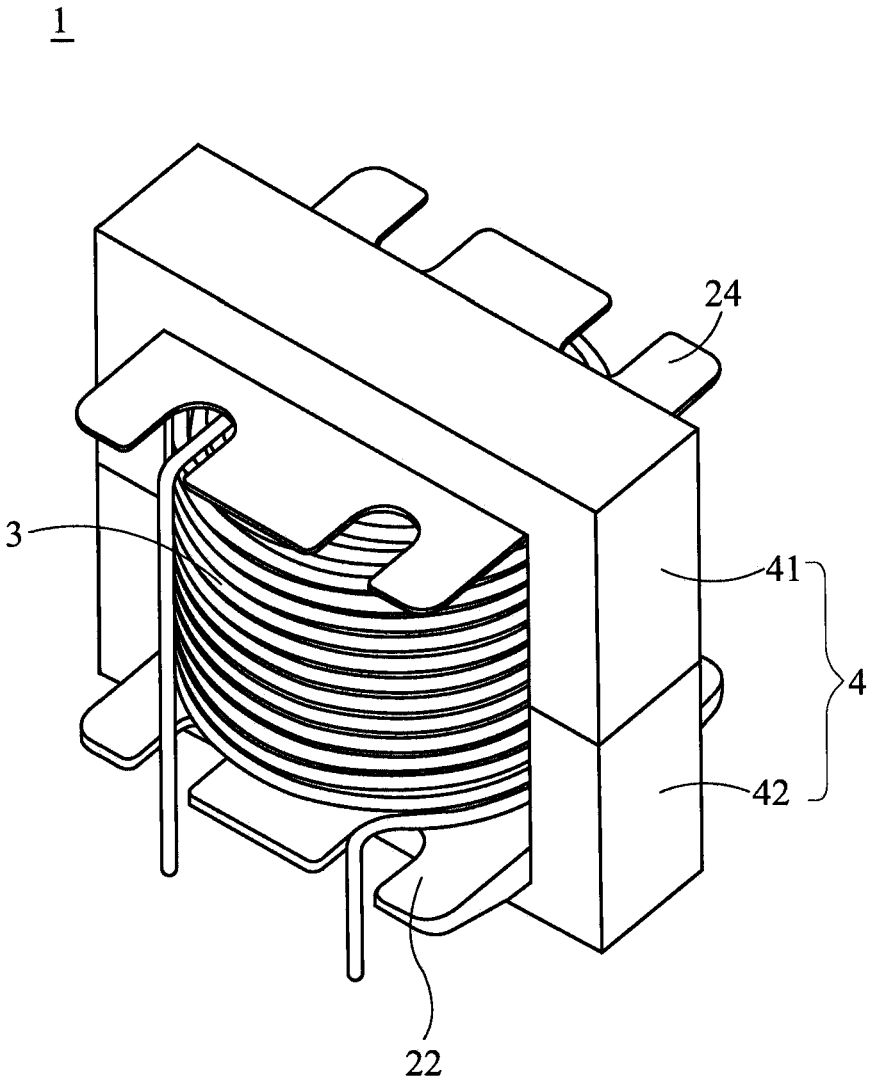
FIG. 1 is a schematic view of a magnetic module according to the present disclosure.
Figure 2:
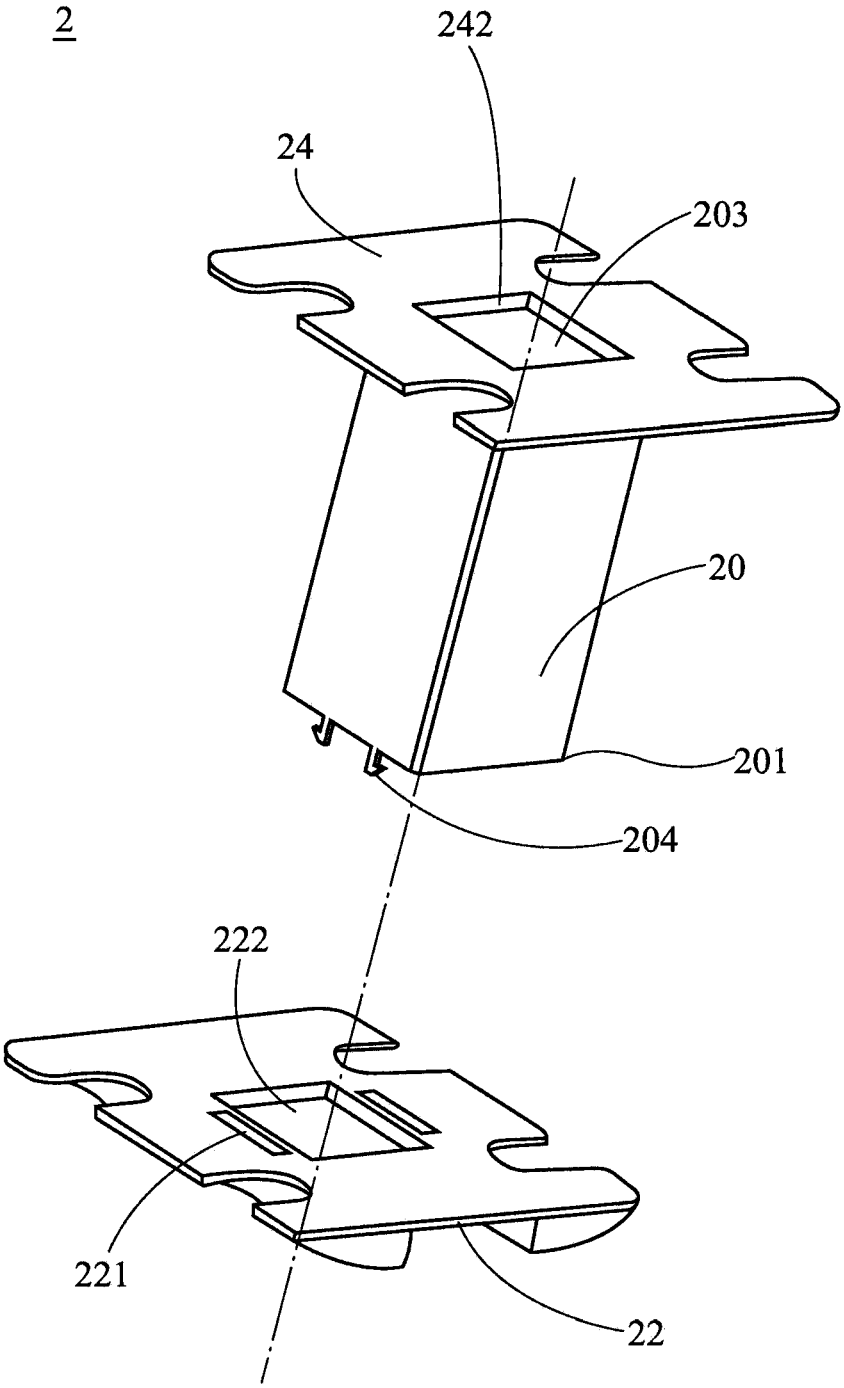
FIG. 2 is a schematic view of a first embodiment of a bobbin according to the present disclosure.

In reference to FIGS. 1 and 2, a magnetic module 1 of the present disclosure comprises a bobbin 2, a winding structure 3 and a magnetic core assembly 4. The winding structure 3 is disposed on a winding body 20 of the bobbin 2, and the magnetic core assembly 4 is partly disposed in a through hole 203 of the bobbin 2. With the aforesaid arrangements, a magnetic module 1 of the present disclosure is formed.

Figure 3:
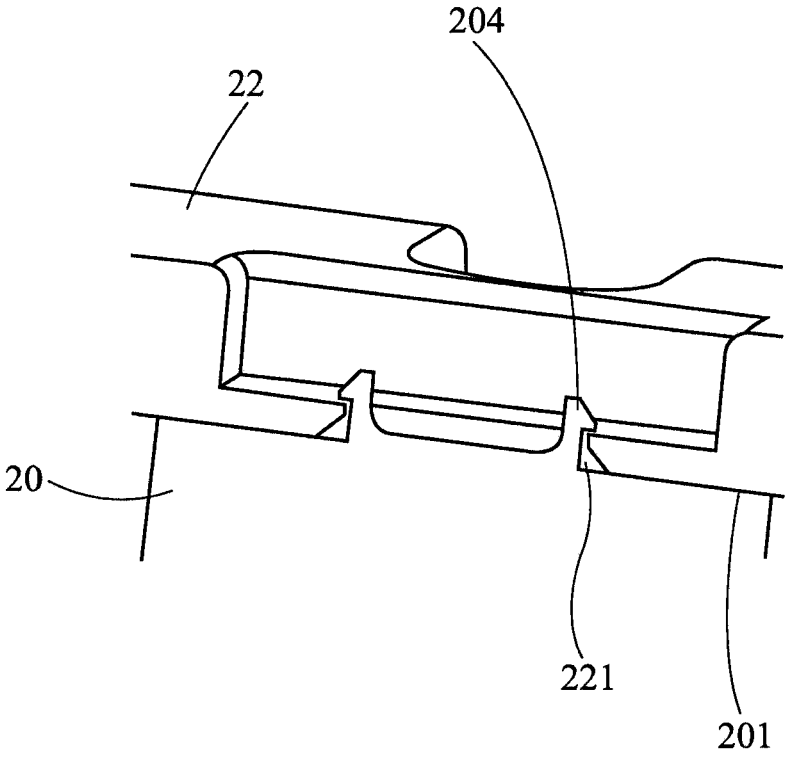
FIG. 3 is a schematic view illustrating a status of engaging a first buckling portion and a second buckling portion shown in FIG. 2.

Specifically, in a first embodiment as shown in FIG. 2, the bobbin 2 has a winding body 20, a first plate 22 and a second plate 24. The winding body 20 comprises a first end 201, a second end 202 which is opposite the first end 201 (not shown in FIG. 2, but shown in FIG. 4), a through hole 203 passing through the first end 201 and the second end 202, and at least one first buckling portion 204 disposed on the first end 201. The first plate 22 comprises at least one second buckling portion 221 and a first opening 222. Thus, as shown in FIG. 3, the at least one first buckling portion 204 of the winding body 20 is adapted to engage with the at least one second buckling portion 221 of the first plate 22, so that the first plate 22 is detachably mounted on the first end 201 of the winding body 20. Additionally, the first opening 222 of the first plate 22 is disposed corresponding to the through hole 203 of the winding body 20. The second plate 24 has a second opening 242 disposed corresponding to the through hole 203 of the winding body 20. In this embodiment, the second plate 24 is integrally formed on the second end 202 of the winding body 20.

In other words, in the first embodiment of the bobbin 2 described above, the first plate 22 engages with the at least one first buckling portion 204 of the winding body 20 by means of the at least one second buckling portion 221, so that the magnetic module 1 of the present disclosure can be easily disassembled and assembled depending on the users' demands. Additionally, the shape of the through hole 203 of the winding body 20 may vary depending on the magnetic core assembly 4. For example, when the magnetic core assembly 4 is a cylinder or a rectangular column, the through hole 203 may be of a circular or rectangular form adapted to partly receive the magnetic core assembly 4.

In reference to FIG. 3 again, to accomplish the engagement that is needed in the present disclosure, the at least one first buckling portion 204 of the winding body 20 is a tongue and the at least one second buckling portion 221 of the first plate 22 is a groove structure. However, the way in which to accomplish the engagement is not limited to this, and any equivalent means that can accomplish the buckling engagement can be used instead.

Figure 4:
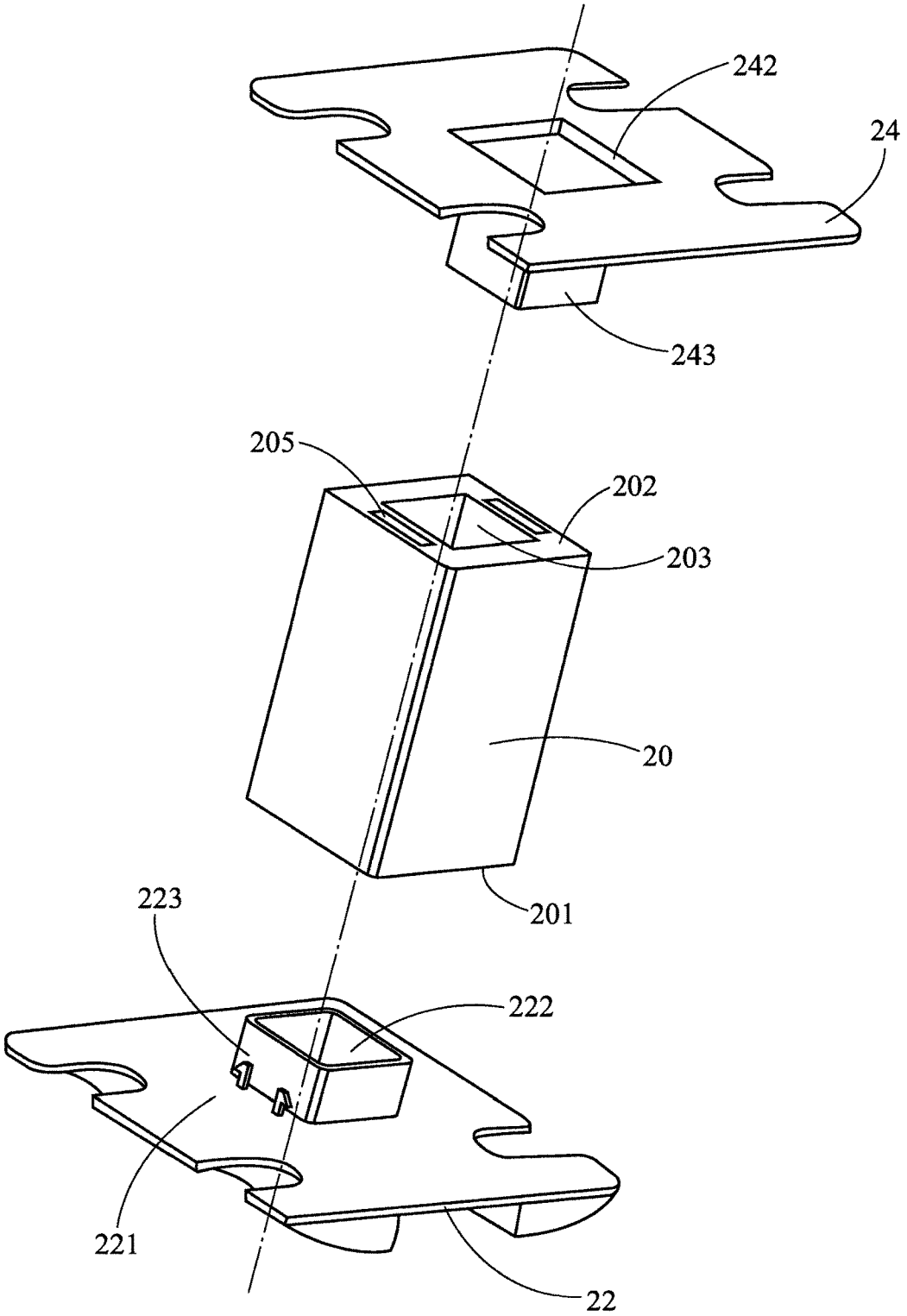
FIG. 4 is a schematic view of a second embodiment of the bobbin according to the present disclosure.

FIG. 4 illustrates the second embodiment of the bobbin 2 of the present disclosure. The second embodiment differs from the first embodiment in that the second plate 24 of the second embodiment is detachably mounted on the winding body 20, and both the first plate 22 and the second plate 24 are further provided with a positioning structure. When the first plate 22 and the second plate 24 are engaged with the winding body 20 respectively, the positioning and fool-proof functions can be achieved.

Furthermore, apart from also having a second opening 242 similar to the first embodiment, the second plate 24 of the second embodiment as shown in FIG. 4 further has at least one fourth buckling portion (not shown) which is a tongue. The at least one fourth buckling portion is adapted to engage with at least one third buckling portion 205 of the winding body 20, and the at least one third buckling portion 205 could be a groove structure. Furthermore, at least one first buckling portion (not shown) disposed on the first end 201 of the winding body 20 is also a groove structure, which is adapted to engage with at least one second buckling portion 221 disposed on the first plate 22. Through the engagement of the first buckling portion with the at least one second buckling portion 221, and engagement of the at least one third buckling portion 205 with the at least one fourth buckling portion, the purpose of joining the first plate 22 and the second plate 24 to both ends of the winding body 20 can be achieved.

Additionally, the first plate 22 and the second plate 24 further comprise at least one first positioning structure 223 and at least one second positioning structure 243 respectively. In reference to FIG. 4, the first positioning structure 223 and the second positioning structure 243 are disposed corresponding to an inner peripheral edge of the through hole 203 respectively; and in the second embodiment as shown in FIG. 4, the at least one first positioning structure 223 and at least one second positioning structure 243 are preferably in the form of a hollow column, and an outer peripheral edge of the hollow column is smaller than the inner peripheral edge of the through hole 203. Thus, when the winding body 20 is engaged with the first plate 22 and the second plate 24 respectively, the positioning and fool-proof functions can be achieved by means of the first positioning structure 223 and the second positioning structure 243. In addition, elements such as the first opening 222, the second opening 242 and the through hole 203 set forth in the second embodiment have the same functions as those in the first embodiment, so no further description will be made herein.

Figure 5A:
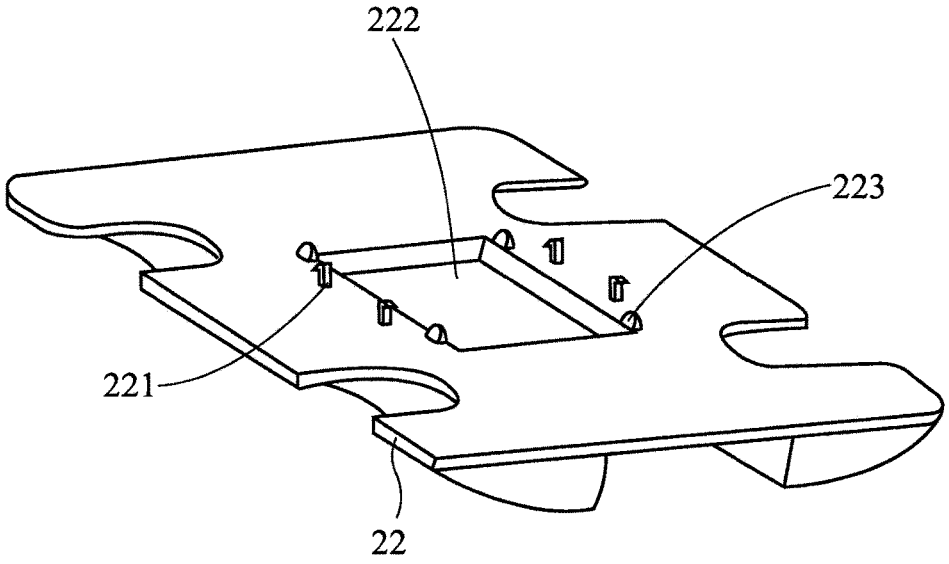
FIG. 5*a* is a schematic view illustrating an example of a positioning structure in the bobbin according to the present disclosure.
Figure 5B:
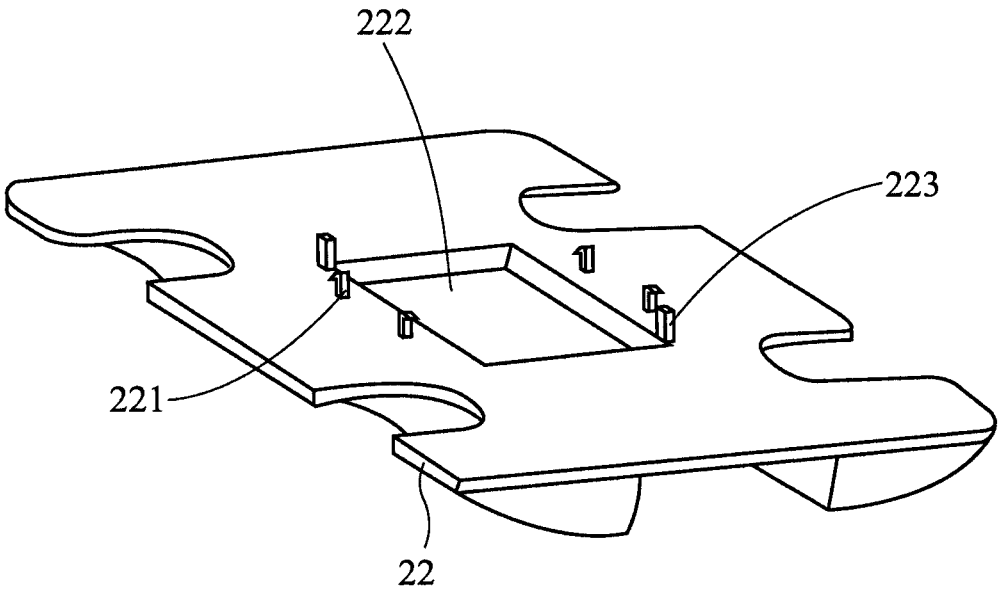
FIG. 5*b* is a schematic view illustrating another example of the positioning structure in the bobbin according to the present disclosure.

It shall be appreciated that the positioning structure of the second embodiment of the present disclosure may also be in other forms than those shown in FIG. 4. As shown in FIG. 5*a*, the at least one first positioning structure 223 is present as four protrusions, which are disposed at the four corners of the first opening 222 respectively and correspond to the inner peripheral edge of the through hole 203 shown in FIG. 4 to provide a positioning function. Likewise, as shown in FIG. 5*b*, the at least one first positioning structure 223 could be two positioning dowels which are disposed at two ends of a diagonal line of the first opening 222. Preferably, the two positioning dowels are disposed corresponding to an inside corners of the rectangular through hole 203 so that a positioning effect can be achieved by using a least number of positioning dowels. In other words, the number and the arrangement of the first positioning structure 223 may vary depending on the actual requirement and the shape of the through hole 203 would also be other condition instead of being merely limited to what is described above. Additionally, because the details of the at least one second positioning structure 243 are just similar to those of the at least one first positioning structure 223, no further description will be made herein.

Figure 6:
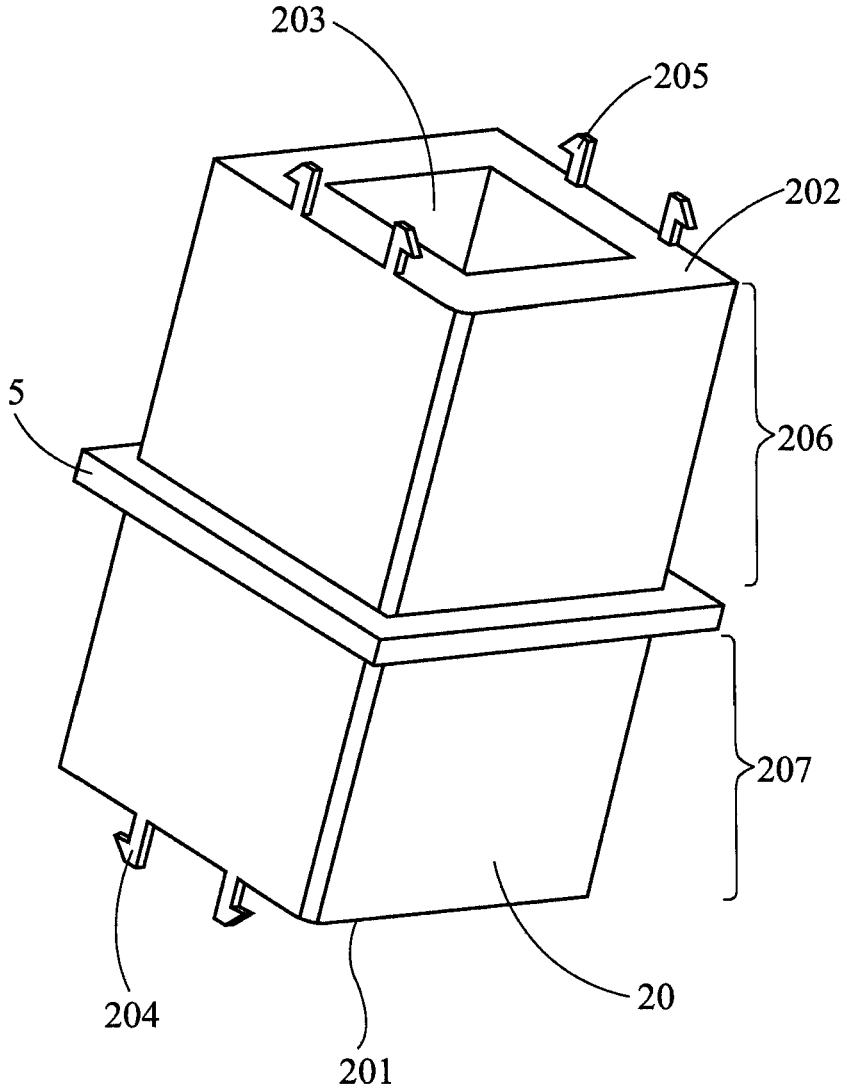
FIG. 6 is a schematic view illustrating another example of a winding body of the bobbin according to the present disclosure.

Besides, as shown in FIG. 6, the magnetic module 1 of the present disclosure further comprises a partition plate 5, disposed on the winding body 20 of the bobbin 2, dividing the winding body 20 into a first winding portion 206 and a second winding portion 207. In this case, the winding structure 3 may also be divided into a primary coil 31 and a secondary coil 32 disposed on the first winding portion 206 and the second winding portion 207 respectively.

Figure 7:
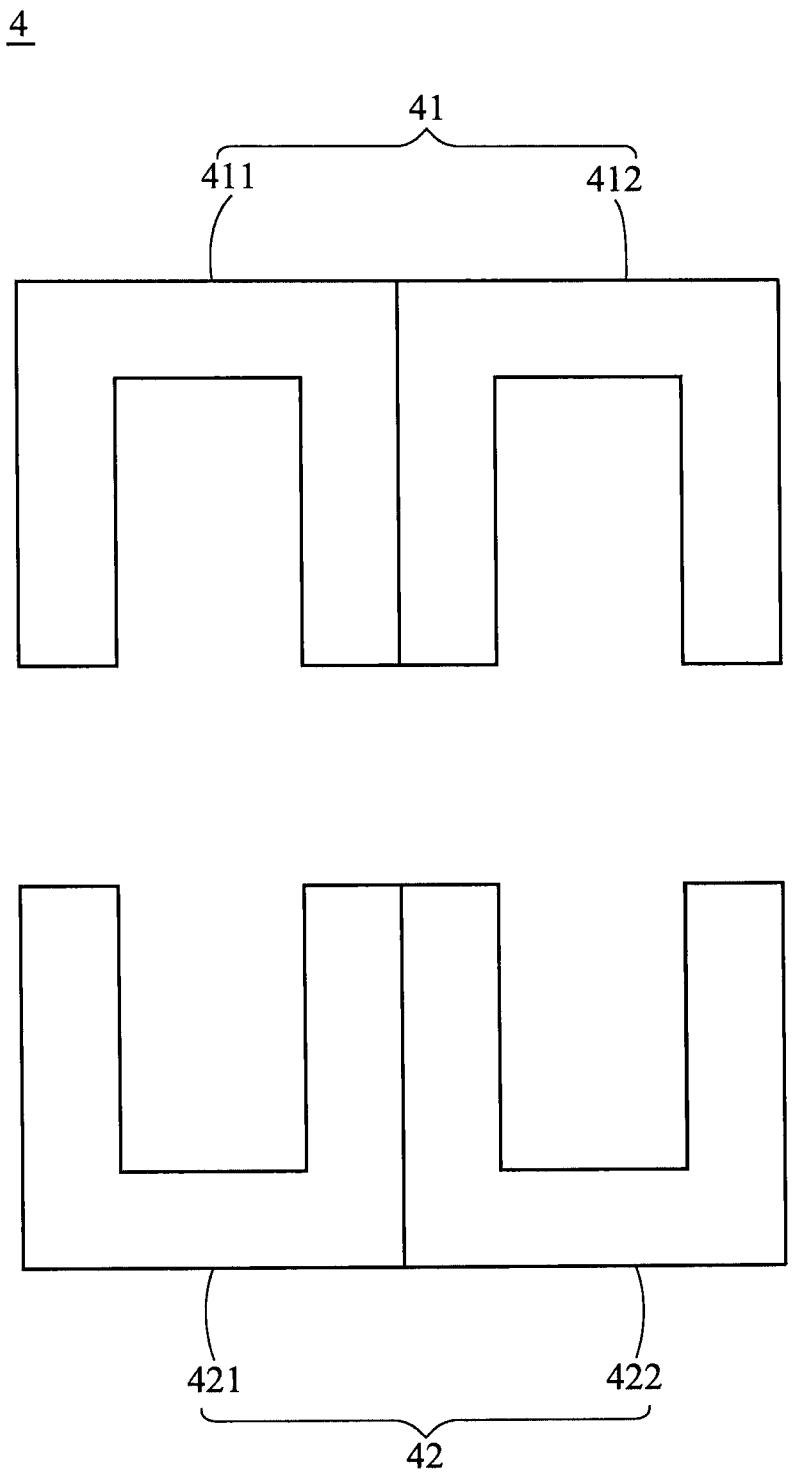
FIG. 7 is a schematic view illustrating another example of a magnetic core assembly of the magnetic module according to the present disclosure.

The magnetic core assembly 4 of the magnetic module 1 of the present disclosure may also be embodied in different forms. As shown in FIG. 1, the magnetic core assembly 4 has a first magnetic core 41 and a second magnetic core 42 which are both E-shaped magnetic cores. The central portion of the first magnetic core 41 and that of the second magnetic core 42 are adapted to be placed in the through hole 203 of the winding body 20 by passing through the first opening 222 of the first plate 22 and the second opening 242 of the second plate 24 respectively. Alternatively, as shown in FIG. 7, the first magnetic core 41 is constructed by two U-shaped magnetic cores 411 and 422, and the second magnetic core 42 is constructed by two U-shaped magnetic cores 421 and 422. The first magnetic core 41 and the second magnetic core 42 are partly embedded into the through hole 203 of the winding body 20 through the first opening 222 of the first plate 22 and the second opening 242 of the second plate 24 respectively to form the magnetic module 1 of the present disclosure.

According to the above descriptions, the bobbin of the present disclosure has a winding body, a first plate and a second plate that can be easily detached and assembled. Therefore, when the winding structure is made of a wire with a larger diameter, the user can wind the wire with the larger diameter into a coil first, then assemble the coil over the winding body. Last, the first plate 22 and the second plate 24 are joined to the first end and the second end of the winding body respectively through the engagement of the first buckling portion with the second buckling portion and the engagement of the third buckling portion with the fourth buckling portion. In this way, damages to the winding body caused by the large winding stress due to a larger wire diameter can be reduced, and problems such as the deflection of the winding structure or leakage of the residual adhesive at the subsequent adhesive stage can be avoided.

The above disclosure is related to the detailed technical contents and inventive features thereof. People skilled in this field may proceed with a variety of modifications and replacements based on the disclosures and suggestions of the disclosure as described without departing from the spirits thereof. Nevertheless, although such modifications and replacements are not fully disclosed in the above descriptions, they have substantially been covered in the following claims as appended.

What is claimed is:

1. A bobbin for use in a magnetic module, the bobbin comprising:

a winding body comprising a first end, a second end opposite the first end, a through hole passing through the first end and the second end, and at least one first buckling portion disposed on the first end;

a first plate comprising at least one second buckling portion and a first opening, the at least one first buckling portion of the winding body being structured to engage with the at least one second buckling portion of the first plate so that the first plate is detachably mounted on the first end of the winding body with the first opening being disposed corresponding to the through hole of the winding body; and a second plate comprising a second opening corresponding to the through hole of the winding body, and the second plate engaged with the second end of the winding body;

wherein the winding body comprising the first end and the first buckling portion is a monolithic structure, the first plate comprising the second buckling portion is a monolithic structure, and the first buckling portion extends along an axial direction of the winding body;

wherein the second end of the winding body comprises at least one third buckling portion, and the second plate comprises at least one fourth buckling portion, the winding body engages with the fourth buckling portion of the second plate by the third bucking portion and the second plate is detachably mounted on the second end of the winding body.

2. The bobbin as claimed in claim 1, further comprising at least one first positioning structure disposed on the first plate.

3. The bobbin as claimed in claim 2, wherein the first positioning structure is a hollow column comprising an outer peripheral edge smaller than an inner peripheral edge of the through hole.

4. The bobbin as claimed in claim 2, wherein the first positioning structure is a plurality of protrusions disposed around the first opening.

5. The bobbin as claimed in claim 1, further comprising at least one second positioning structure disposed on the second plate.

6. The bobbin as claimed in claim 5, wherein the second positioning structure is a hollow column comprising an outer peripheral edge smaller than an inner peripheral edge of the through hole.

7. The bobbin as claimed in claim 5, wherein the second positioning structure is a plurality of protrusions disposed around the second opening.

8. A magnetic module, comprising:

a bobbin as claimed in claim 1;

a winding structure disposed on the winding body of the bobbin; and a magnetic core assembly partly disposed in the through hole of the bobbin.

9. The magnetic module as claimed in claim 8, wherein the winding structure comprises a primary coil and secondary coil.

10. The magnetic module as claimed in claim 9, further comprising a partition plate disposed on the winding body of the bobbin, the partition plate divides the winding body into a first winding portion and a second winding portion, and the primary coil and the secondary coil are disposed on the first winding portion and the second winding portion, respectively.

* * * * *